US005291666A

United States Patent [19]

Babinsky et al.

[11] Patent Number: 5,291,666

[45] Date of Patent: Mar. 8, 1994

[54] APPARATUS FOR DRYING ROLL MATERIAL

[75] Inventors: Vladislva A. Babinsky, Spring Valley; Warren G. Mumford, Cornwall-on-Hudson, both of N.Y.

[73] Assignee: International Paper Company, Purchase, N.Y.

[21] Appl. No.: 52,441

[22] Filed: Apr. 23, 1993

[51] Int. Cl.[5] ..... F26B 7/00

[52] U.S. Cl. ..... 34/18; 34/117; 34/120; 162/206

[58] Field of Search ..... 34/13, 18, 23, 114, 34/115, 116, 117, 120, 122, 123, 151, 124, 66, 68; 162/203, 206, 207

[56] References Cited

U.S. PATENT DOCUMENTS

| | | | |
|---|---|---|---|
| 737,817 | 9/1903 | Barber | 34/36 |
| 2,207,278 | 7/1940 | Albrecht | 34/95 |
| 2,209,761 | 7/1990 | Berry | 162/205 |
| 2,224,803 | 12/1940 | Standley | 34/66 |
| 2,526,318 | 10/1950 | Battin . | |
| 2,661,669 | 12/1953 | Friederich | 162/207 |
| 3,046,771 | 7/1962 | Bailey | 68/5 |
| 3,077,673 | 2/1963 | Cohen | 34/13 |
| 3,079,699 | 3/1963 | Fry | 34/13 |
| 3,096,161 | 7/1963 | Morrison | 34/68 |
| 3,191,312 | 6/1965 | Allander | 34/13 |
| 3,214,327 | 10/1965 | Wicker | 34/95 |
| 3,354,035 | 11/1967 | Gottwald | 34/123 |
| 3,471,363 | 10/1969 | Schmidt | 162/197 |
| 3,503,139 | 3/1970 | Mahoney | 34/111 |
| 3,525,160 | 8/1970 | Dokoupil | 34/95 |
| 3,925,906 | 12/1975 | Chance | 34/123 |
| 3,973,329 | 8/1976 | Feess | 34/71 |
| 4,050,510 | 9/1977 | Theysohn | 34/124 |
| 4,112,586 | 9/1978 | Lehtinen | 34/95 |
| 4,202,113 | 5/1980 | Kankaanpaa | 34/116 |
| 4,457,145 | 7/1984 | Sando | 8/444 |
| 4,461,095 | 7/1984 | Lehtinen | 34/124 |
| 4,506,456 | 3/1986 | Lehtinen | 34/73 |
| 4,506,457 | 3/1985 | Lehtinen | 34/66 |
| 4,622,758 | 11/1986 | Lehtinen | 34/116 |
| 4,625,430 | 12/1986 | Aula | 34/66 |
| 4,738,197 | 4/1988 | Malkia | 162/206 |
| 4,776,186 | 10/1988 | Riedel | 68/5 |
| 4,887,362 | 12/1989 | Rautakorpi | 34/73 |
| 4,889,598 | 12/1989 | Niskanen | 162/206 |
| 4,899,461 | 2/1990 | Lehtinen | 162/206 |
| 4,922,627 | 5/1990 | Hernandez | 34/116 |
| 4,932,139 | 6/1990 | Lehtinen | 34/95 |
| 4,958,444 | 9/1990 | Rautakorpi | 34/95 |

*Primary Examiner*—Henry A. Bennet
*Assistant Examiner*—Denise Gromada
*Attorney, Agent, or Firm*—Ostrager, Chong & Flaherty

[57] ABSTRACT

An apparatus for drying a web of roll material has two rows of comparatively low and high temperature cylinders, and a metal belt and a felt belt entrained in parallel for transporting the web on a serpentine path around the cylinders. The metal belt is pre-heated at an input side to each low temperature cylinder to a temperature from 140° C. to 170° C. An input press roll applies a nip pressure to the metal belt against the web, felt belt, and low temperature cylinder from 60 to 200 pli (pounds per linear inch). The surface of the low temperature cylinder is heated to an intermediate temperature from 100° C. to 140° C. The temperature of the heated belt at an input side is maintained only about 20° C. higher than that of the low temperature cylinder. The low temperature cylinder has air pressure grooves for maintaining a negative air pressure in the range of 0.1 to 0.7 bar at its surface for lowering the vapor pressure for water evaporated from the web. A uniform drying and densification of the web is obtained, without excessive buildup of web pressure or breaking or delamination of the web.

20 Claims, 4 Drawing Sheets

APPARATUS FOR DRYING ROLL MATERIAL

FIELD OF THE INVENTION

This invention generally relates to an apparatus for drying roll material, and particularly to an apparatus for improving strength properties of a web of roll material while providing efficient drying without breaks or delamination.

BACKGROUND ART

The fabrication of many types of paper, board, fabric, and other roll materials usually includes a drying stage for drying a web of material formed in a wet process. Many different systems have been devised for such drying of roll materials. Commercial systems typically have employed one or more heated, rotating drums and a porous wire or felt belt for supporting a web fed between the heated drum surface and the belt. However, web breaks have been a problem with such systems, particularly with lighter webs. If the drums were heated to high temperatures to effect a higher drying rate, uneven drying and curling of the roll material could result. The older systems also do not provide desired high strength properties of the web.

Other systems, such as shown in U.S. Pat. No. 3,503,139 of Mahoney, have employed dual rows of alternating high temperature (heating) and low temperature (cooling) drums, with an entrained wire or felt belt for transport of the web in a serpentine path around the drums, in order to effect a more gradual evaporation of water from the web. However, these systems had problems with breaking of the web as it is repeatedly moved in and out of contact with the high and low temperature drum surfaces. Some improved systems, such as shown in U.S. Pat. No. 3,925,906 of Chance et al., have employed two wire or felt belts in parallel for holding the web more stably between them as it is transported around the drums. Heated belts combined with porous drums for removal of vapor have also been used. However, the maintenance of an adequate transfer of heat and evenness of drying of the web along the transport path around the drums has been a major problem. Another approach has been to transport the web held between belts along a linear path between stationary heated elements, but this raises other problems in terms of adequate ventilation and vapor removal from the web path.

One recent system, shown in U.S. Pat. No. 4,622,758 of Lehtinen et al., has employed transport of the web between a heated metal belt and a felt belt around a cooling cylinder for evaporating water from the web for condensation into the felt belt and onto the cooling cylinder. As illustrated in FIG. 4 of the drawings, this system of Lehtinen et al. has a metal belt 6 entrained around four spaced-apart heated drums 1, 3, 4, 5. A paper web 8 is transported by a wire or felt belt 9 to a nip with the metal belt 6 around the first drum 1. The web held between the belts is then transported around the cooling cylinder 2 where a semi-circular air pressure chamber 16 is used to apply pressure to increase the temperature of the evaporated steam and to force evaporation of water from the web. Condensate is removed by a scraper 13 from the drum, while condensate in the wire or felt belt 9 is removed by a downstream suction box 23. After leaving the cooling cylinder, the web 8 is separated from the belts and passed to a second drying unit.

The system of Lehtinen et al. suffers from the following drawbacks. The semi-circular air pressure chamber 16 can exert excessive loading on the rotating cooling cylinder 2, and the system requires a second pressure box 20 located opposite the first one to counterbalance the load on the cylinder. As the web leaves the area of the pressure chamber 16 and the cooling cylinder 2, the external pressure on the web is suddenly released, while the temperature and vapor pressure within the web remains high. As a result, the vapor pressure can explode outward, thereby causing damage or at least delamination to the web. In addition, since the high pressure of the pressure chamber 16 and the high temperature of the heated metal belt 6 are applied only to one side of the web 8, and low temperature exists at the other side, the material on the heated side dries first, leading to non-uniform densification and resistance to further drying on that one side of the web. When the web is removed from the belt, the steam has to go through the densified layer, thereby leading to delamination. Further, removal of the web 8 from the metal belt 6 after leaving the cooling cylinder 2 can lead to sticking and breaks in the web as it is separated and transported to subsequent stages.

The temperature of the cooling cylinder has to be kept low in order to obtain the necessary condensation of moisture. The intensity of drying has heretofore been controlled by the temperature of the cylinders, but because of the very high, heat inertia of the cylinders, control by cylinder temperature has proven to be slow and inefficient. The condensed vapor will also become collected in the voids of the wire belt, and will limit the amount of water that can be removed from the web. This may require increased thickness of the wire, and may cause secondary re-wetting of the web after it leaves the cylinder. Therefore, the problems of non-uniformity of drying and uneven web densification have been difficult to solve.

SUMMARY OF THE INVENTION

In the present invention, two rows of rotating cylinders of comparatively low and high temperature are employed. A web is transported on a serpentine path around the cylinders between a heated belt on one side and a porous (felt) belt on the other side. As the web is transported around at least one low temperature cylinder, the porous belt makes contact with the surface of a low temperature cylinder, while one or more press rolls are used to press the heated belt against the web, porous belt, and cylinder. The web leaving the low temperature cylinder remains held between the heated belt and the porous belt and is then transported around a high temperature cylinder. The heated belt makes contact with the surface of the high temperature cylinder and is re-heated, while the porous belt is ventilated on the open side away from the high temperature cylinder surface. The web and belts are then transported around a second low temperature cylinder and may be passed to subsequent high and low temperature cylinders to repeat the drying cycle until the desired drying level is obtained.

In a preferred embodiment, the heated belt is preheated to a temperature from 140° C. to 170° C., preferably about 140° C., at the input side to the low temperature cylinder. The low temperature cylinder is heated to a temperature from 100° C. to 140° C., preferably about 110° C. The temperature of the heated belt at the input side is kept within a range from 10° C. to 30° C., preferably 20° C., higher than that of the low temperature cylinder. An input press roll is arranged close to the point of contact of the web and belts with the low temperature cylinder, and applies a nip pressure from 60 to 200 pli (pounds per linear inch), preferably 100 pli. The surface of the low temperature cylinder is provided with air grooves, and a vacuum unit is employed to maintain a slightly negative pressure of about 0.1 to 0.7 bar at the felt side of the web.

The system of the present invention combines several advantageous effects at the same time. The high nip pressure of the press roll and the heated belt provide sufficient pressure and temperature for efficient evaporation of water from the web as well as for even densification of the web. Since the temperature of the belt and the web gradually decreases during transit around the cylinder, the chances of delamination are reduced. The negative air pressure at the cylinder surface allows for efficient vapor removal. The temperature of the low temperature cylinder can therefore be kept within a relatively small difference from that of the heated belt. The relatively small temperature difference between the heated belt and low temperature cylinder ensures a uniform drying and densification of the web, without excessive buildup of web pressure or temperature. After leaving the low temperature cylinder, the web remains held between the heated belt and porous belt to avoid breaking or delamination of the web, then the web is subject to a gradual re-heating of the heated belt around the high temperature cylinder while continuing to have vapor transport through the porous belt on the ventilated side. The web continues to be held between the heated belt and porous belt around subsequent low temperature and high temperature cylinders, and is not removed from the belts until drying has reached a stabilized level. The vacuum pressure in the grooves of the low temperature cylinder can be used for effective control of the drying process. Change of the vacuum pressure can provide a quick change in the process, and the thermal inertia of the cylinders need not be involved in the process change.

Other objects, features and advantages of the present invention are described in further detail below in conjunction with the drawings, as follows:

DETAILED DESCRIPTION OF THE INVENTION

Figure 1:
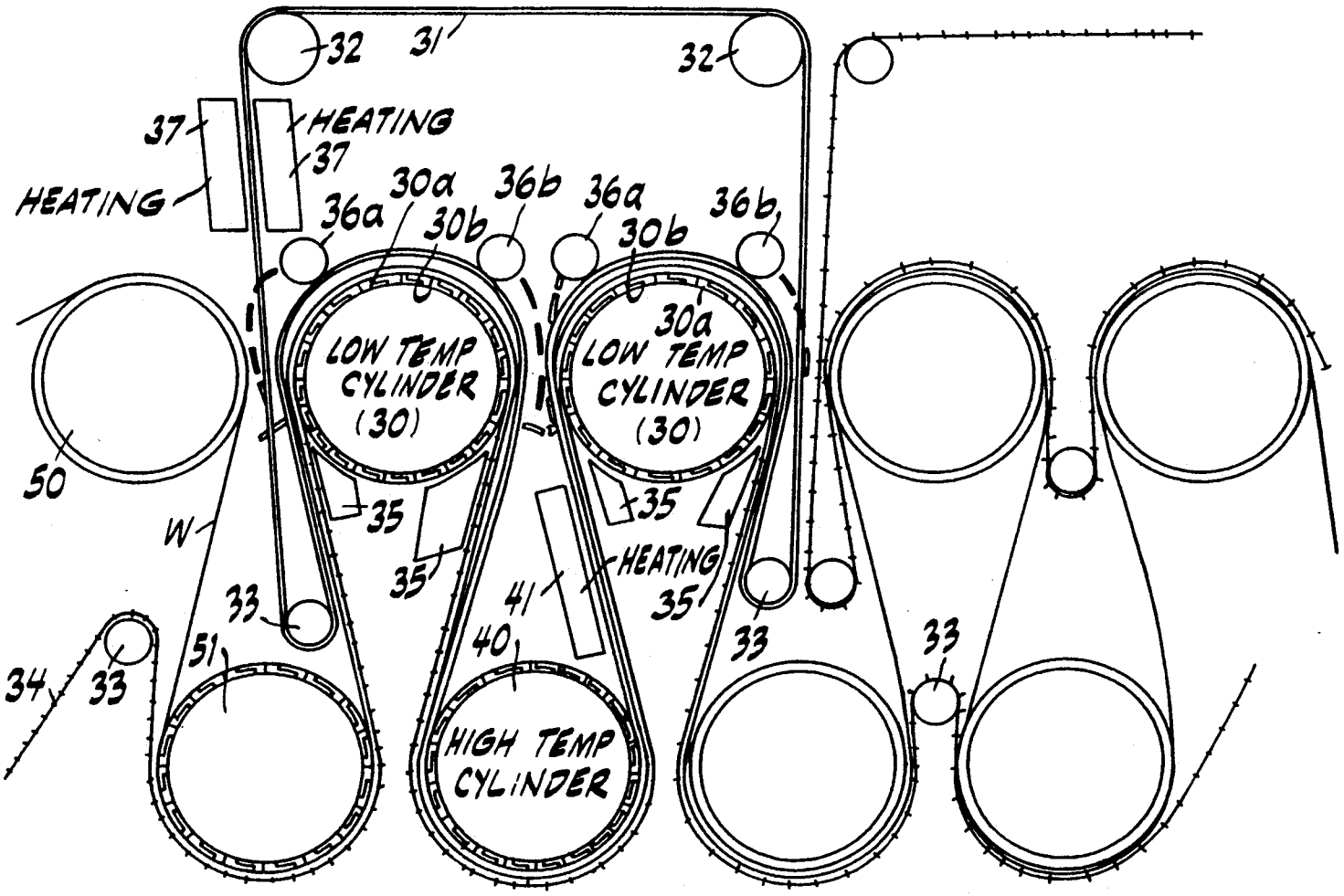
FIG. 1 is a schematic diagram illustrating an apparatus for drying roll material in accordance with the invention.

Referring to FIG. 1, a drying system in accordance with the present invention employs rotating, comparatively low temperature cylinders, and high temperature cylinders. One or more low temperature cylinders 30 are arranged in one row, while one or more high temperature cylinders 40 are arranged in another row. A moisture-impermeable heated belt 31 made of metal or other suitable material is entrained around rollers 32, 33 so as to follow an endless path around the low and high temperature cylinders 30 and 40. A moisture-permeable (porous) belt made of felt or other suitable material is entrained around rollers 33 so as to also follow an endless path around the low and high temperature cylinders 30 and 40. A web W of paper, board, or other roll material fabricated in a wet process is transported on a serpentine path alternately around the low and high temperature cylinders sandwiched between the metal belt 31 on one side and the felt belt 34 on the other side.

As the web and belts are transported around a first low temperature cylinder 30, the felt belt 34 comes into contact with the cylinder surface for evaporation of water and removal from the web. The web leaving the low temperature cylinder continues to be held between the metal belt and felt belt and is transported around a high temperature cylinder 40. Due to the serpentine path, the metal belt comes into contact with the surface of the high temperature cylinder and is re-heated. The web and belts may be transported around a second low temperature cylinder 30 for further drying. Additional low and high temperature cylinders 30 and 40 may be arranged for repeating the drying process in a similar manner.

The low temperature cylinder(s) 30 has a surface provided with grooves **30*a* for maintaining a slightly negative air pressure at the its surface. The negative pressure is maintained by means of vacuum chambers 35 connected by brush seals to air channels on the cylinder in communication with the grooves. The interior of the low temperature cylinder 30 is formed with a sealed chamber 30*b* not in communication with the grooves 30*a*. Steam heat can be provided into the sealed chamber 30*b*** in order to maintain the surface of the cylinder at a desired intermediate temperature, as will be described further herein. Alternatively, the desired temperature level of the low temperature cylinder may be maintained by heating coils or other elements.

Assemblies of rotating cylinders with air pressure grooves are commonly used in the paper industry for transporting (and drying) a paper web, e.g., as commercially sold by Valmet Company, of Finland. These types of grooved cylinders typically have a diameter of 1.5 to 2 meters, and grooves of 2 to 3 mm. width and 1 to 2 mm. spacing. They are adapted to the system of the present invention in order to accomplish different purposes, namely, to maintain a low temperature of the cylinder while using the negative air pressure to control and lower the vapor pressure for removing evaporated moisture from the web W, and to maintain the pressure differential between the metal belt and the low temperature cylinder. Since such grooved cylinders are known conventionally, the details of their structure need not be described further herein.

An input press roll **36*a* is arranged at a position close to the point of contact of the web and belts with the low temperature cylinder. A desired range for positioning of the input press roll 36*a* is within about 30% of the circumference of the cylinder from the point of contact (indicated by dashed lines in FIG. 1). The input press roll 36*a* applies a relatively high pressure at a point contact on the metal belt 31 against the web W, the felt belt 34, and the surface of the low temperature cylinder 30. The press roll pressure can be varied by hydraulic control. An exit press roll 36*b*** is similarly provided within about 30% of the circumference of the cylinder from the point of the web leaving the cylinder (also indicated by dashed lines), so as to maintain the pressurized holding of the web within the belts over the length of contact with the cylinder. Placement of the input and exit press rolls on opposite sides of the cylinder balances the loading on the cylinder. The press rolls apply a desired level of high pressure contact to effect heat transport and evaporation of water from the web through the felt belt to the low temperature cylinder and to densify the web in order to improve web strength properties.

The high temperature cylinder(s) 40 may also be of the type having an interior chamber into which steam heat can be provided for heating the cylinder to a desired temperature. Alternatively, heating may be accomplished with heating coils or other devices. Another heating element 41 may be provided to heat the metal belt 31, so that the re-heating load for the metal belt can be divided with the heating cylinder 40. This has the advantage that re-heating of the metal belt can be accomplished more gradually so as to maintain more uniform drying. Heating of the metal belt around the high temperature cylinder while the felt belt is ventilated at the open side allows continued drying of the web during re-heating.

After the metal belt 31 leaves the last low temperature cylinder in a given drying stage, it is returned to the input side of the first low temperature cylinder by entrainment on the rollers 32, 33. Heating elements 37 are provided along a length of belt run ahead of the input side for pre-heating of the metal belt to the desired level of elevated temperature for the heated belt.

Also shown in FIG. 1 is a first input drum 50 for guiding the wet web W onto the felt belt 34, and a second input drum 51 for mating the web W into contact with the felt belt. The second input drum 51 may be provided with interior steam heating for elevating the temperature of the web prior to entry to the first low temperature cylinder. At the output side of the drying stage, the web W may be transported by the felt belt to another of the same type of drying stage or a cool-down stage (shown in the drawings) employing a second felt belt for transport.

The preferred characteristics of a drying system for handling a wet web of paper pulp are as follows. Typically, such webs have a width of up to 20 feet. For liner board, the web enters the drying stage wet with a weight density of 3.1 lbs. per thousandth of an inch thickness, and leaves the drying stage dried and compressed with a weight density of 4.0 lbs. per thousandth inch thickness. For drying this type of roll material, the metal belt is pre-heated to a temperature from 140° C. to 170° C., preferably 140° C., at the input side to the cooling cylinder. The cooling cylinder is heated to a temperature from 100° C. to 140° C., preferably about 110° C. The temperature of the metal belt at the input side is kept within a range from 10° C. to 30° C., preferably 20° C., higher than that of the low temperature cylinder. The negative air pressure at the surface of the low temperature cylinder is in the range of 0.1 to 0.7 bar, preferably about 0.5 bar. The input press roll pressure can be from 60 to 200 pli, preferably 100 pli (20 kn/m).

The negative pressure at the grooved surface of the low temperature cylinder lowers the vapor pressure at the cylinder surface, thereby facilitating transport of vapor from the web and reducing the temperature differential required between the metal belt and the low temperature cylinder. The relatively small temperature differential prevents an excessive buildup of vapor pressure in the web that might result in vapor explosion and delamination of the web when it leaves the cylinder, and also provides uniformity of densification of the web. Under the above conditions, the metal belt temperature declines from 140° C. at the input side to about 120° C. at the exit side of the cylinder, while the temperature of the web becomes elevated to about 130° C. at the input side and declines to about 120° C. at the exit side. The temperature of the web decreases gradually as the temperature of the heated belt decreases. The vapor pressure in the web around the low temperature cylinder declines from about 6 bar at the position of the input press roll to about 1.5 bar at the exit side. The pressure on the web against the cylinder due to belt tension is preferably in the range of 0.5–3.0 bar.

Figure 2:
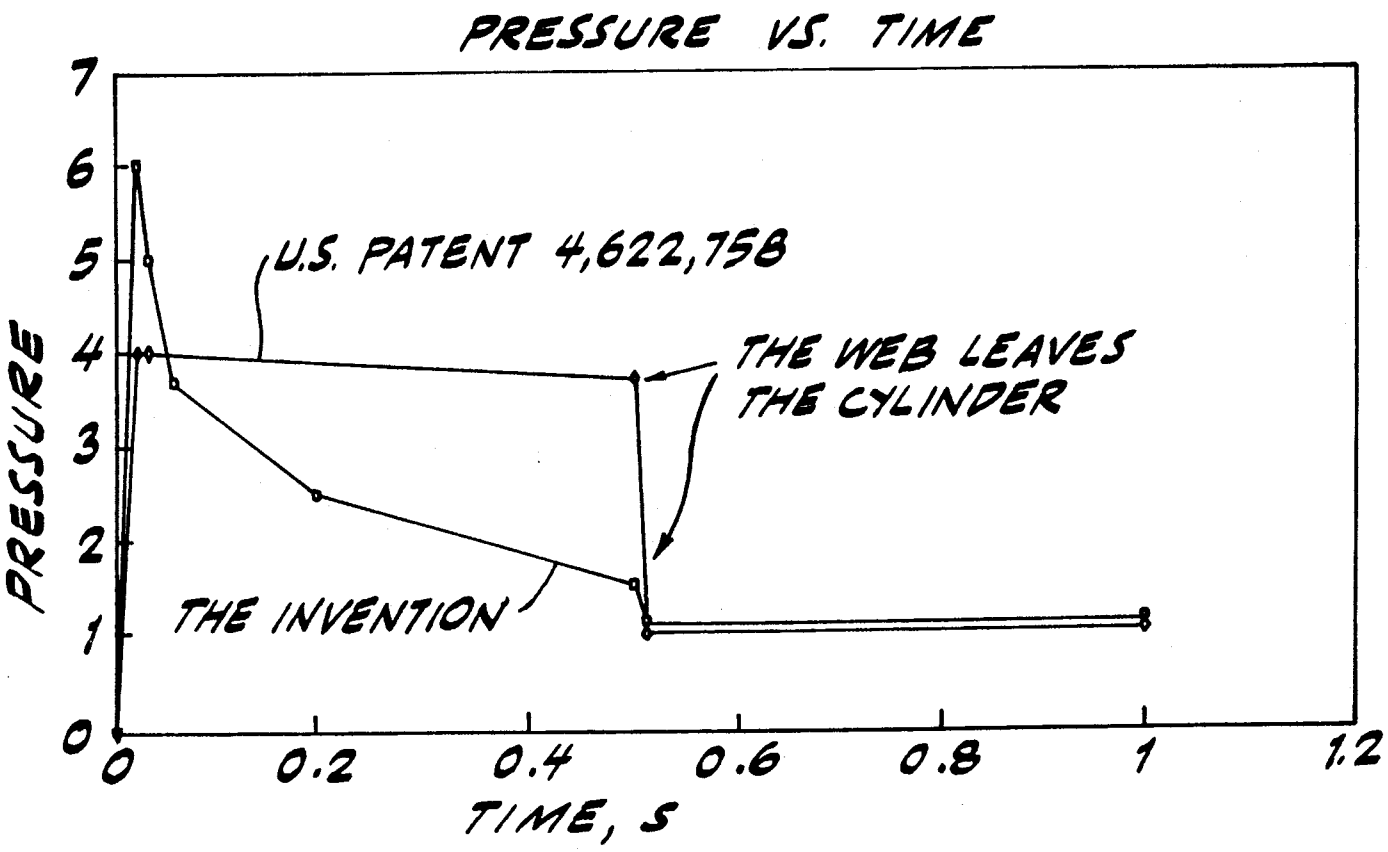
FIG. 2 is a comparative chart showing the pressure characteristics of the invention compared to the prior system of U.S. Pat. No. 4,622,758.
Figure 3:
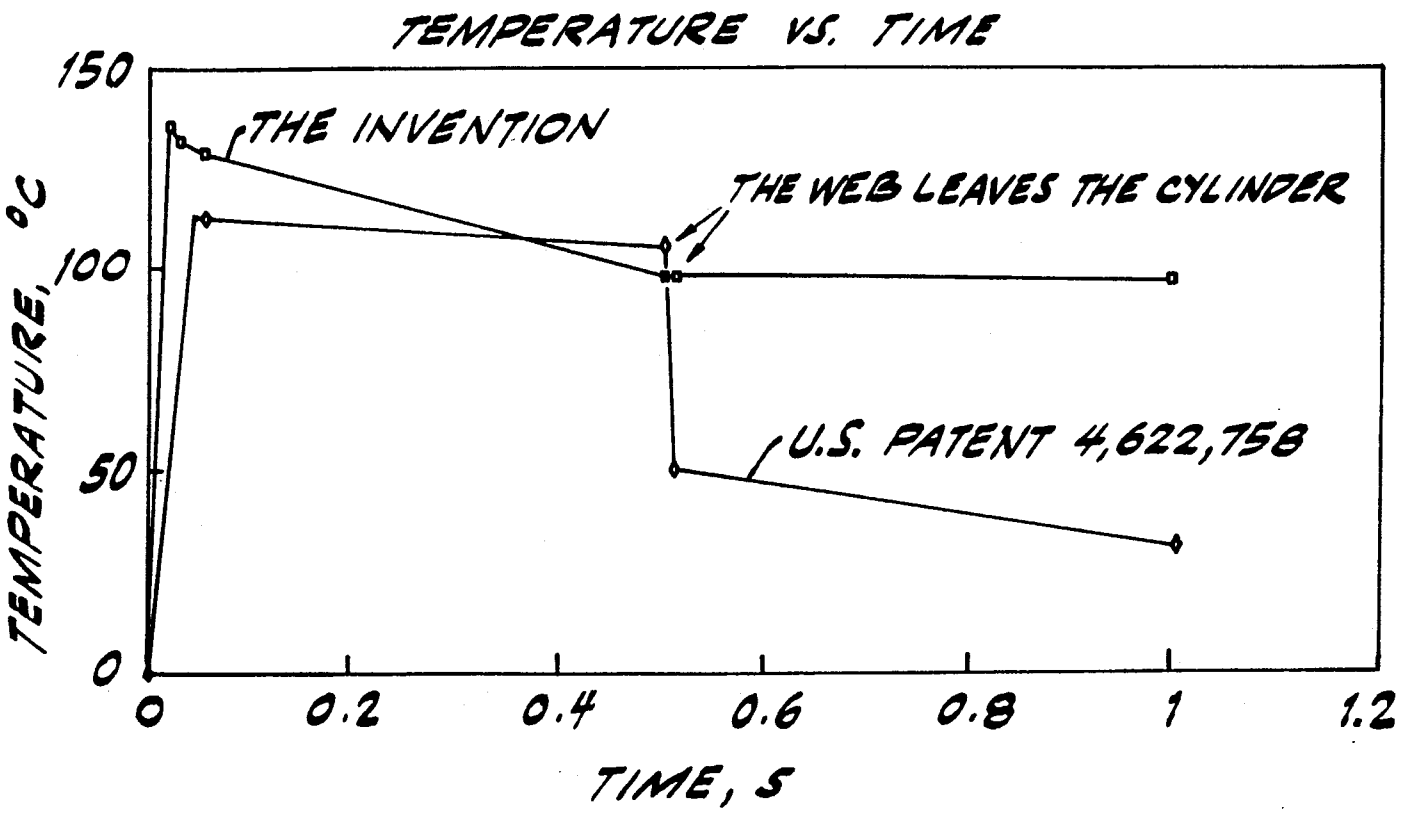
FIG. 3 is a comparative chart showing the temperature characteristics of the invention compared to the prior system of U.S. Pat. No. 4,622,758.
Figure 4:
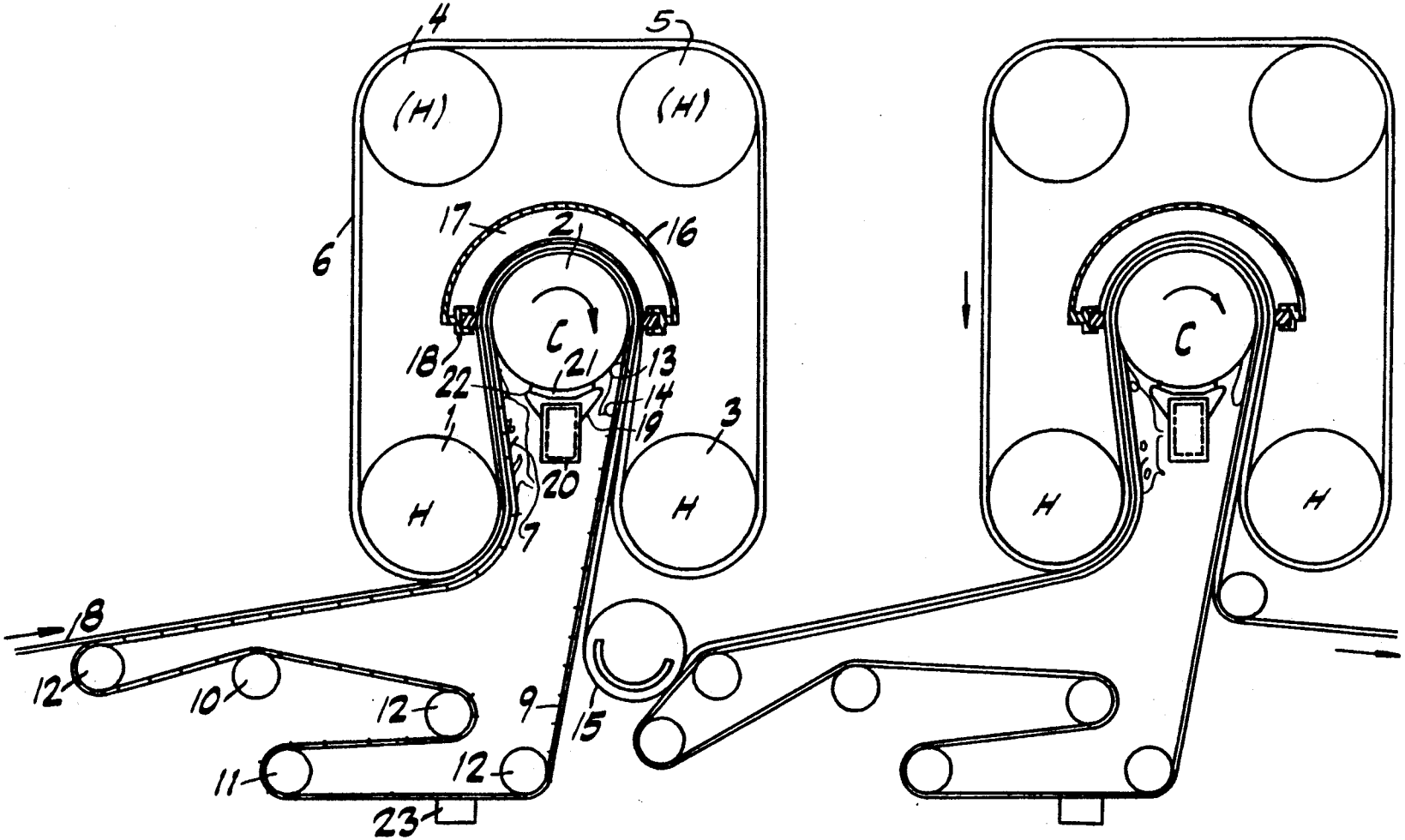
FIG. 4 PRIOR ART
FIG. 4 illustrates as prior art a roll material drying system as disclosed in U.S. Pat. No. 4,622,758.

When the web leaves the low temperature cylinder, delamination will not occur because of the web temperature and pressure has gradually declined and there is no sharp dropoff upon leaving the cylinder. As shown in FIG. 2, the pressure dropoff upon leaving the cylinder is only about 0.5 bar. The web also remains sandwiched between the metal belt and the felt belt. Therefore, as shown in FIG. 3, there is little temperature dropoff in the web upon leaving the cylinder. Delamination occurs when there is a sharp dropoff or decompression of the web. Compared to the present invention, the system shown in U.S. Pat. No. 4,622,758 of Lehtinen et al. would have a sharp dropoff in web pressure of about 3 bar after leaving the cylinder and a sharp drop in temperature due to removal of the metal belt from the web.

As the web is transported around the heating cylinder, its temperature is about 95° C. The high temperature cylinder gradually reheats the metal belt in order to continue the transfer of thermal energy to dry the web and to re-elevate the temperature of the metal belt for entry to a next cooling cylinder. Upon leaving the heating cylinder, the metal belt is incrementally heated by the additional heating element 41 to the 140° C. level, and the web temperature reaches about 110° C. Thus, the web and belts are ready to enter a similar drying process around the second low temperature cylinder.

The arrangement of the system of the present invention maintains gradual changes in temperature and pressure as the web is transported around the low and high temperature cylinders, thereby ensuring that delamination is avoided. The moisture evaporated from the web by the heat of the metal belt is kept from flashing by the lowered vapor pressure due to the negative pressure maintained at the surface of the low temperature cylinder and by the low temperature differential. These conditions also ensure a uniformity of drying, so that non-uniform drying and densification of the web at the heated belt side are avoided. The maintenance of contact of the web with the smooth surfaces of the metal and felt belts during the drying process ensures that the desired smoothness and finish properties of the paper web is maintained. The pressure of the press rolls and the vacuum pressure in the grooves as well as the temperatures of the metal belt, low temperature cylinders, and high temperature cylinders may be adjusted independently of each other to obtain the optimal drying characteristics. Multistage processing may be used for further drying or to develop comparable finish properties on both sides of the web.

Although the invention has been described with reference to certain preferred embodiments, it will be appreciated that many other variations and modifications thereof may be devised in accordance with the principles disclosed herein. The invention, including the described embodiments and such variations and modifications thereof, is defined in the following claims.

We claim:

1. An apparatus for drying a web of roll material, comprising:

two rows of rotating, comparatively low temperature and high temperature cylinders, wherein a first row has at least one low temperature cylinder with an external contact surface, a second row has at least one high temperature cylinder with an external contact surface, and the web is transported on a serpentine path alternatingly around the surfaces of said low and high temperature cylinders;

a heated belt and a porous belt, each being entrained to run in parallel with the web held between them on the serpentine path around the surfaces of said cylinders, wherein, as the web is transported around the at least one low temperature cylinder, the porous belt makes contact with the surface of said low temperature cylinder, and as the web is transported around the at least one high temperature cylinder, the heated belt makes contact with the surface of said high temperature cylinder;

belt heating means for heating said heated belt to a desired elevated temperature prior to a contact position of the web and said belts on an input side of said low temperature cylinder;

pressure means including at least an input press roll located in proximity to the contact position on the input side of said low temperature cylinder for applying a desired high pressure to the heated belt against the web, said porous belt, and the surface of said low temperature cylinder;

negative air pressure means for providing a negative air pressure at the surface of said low temperature cylinder in order to facilitate evaporation of water from the web through said porous belt to the surface of said low temperature cylinder; and cylinder heating means for heating said high temperature cylinder for re-heating said heated belt after leaving said low temperature cylinder.

2. An apparatus according to claim 1, wherein said first row includes a second low temperature cylinder, and said negative air pressure means includes further means providing a negative air pressure at the surface of said second low temperature cylinder.

3. An apparatus according to claim 2 further comprising further belt heating means for heating said heated belt to a desired elevated temperature prior to entry into contact of the web and said belts on an input side of said second low temperature cylinder.

4. An apparatus according to claim 1, wherein said negative air pressure means is comprised by said low temperature cylinder having a surface provided with air grooves in communication with air channels provided on said low temperature cylinder, and an external vacuum generating unit connected by brush seals to the air channels for supplying negative air pressure to said grooves.

5. An apparatus according to claim 1 further comprising further cylinder heating means for heating the surface of said low temperature cylinder to a desired intermediate temperature.

6. An apparatus according to claim 5, wherein the temperature of the heated belt at the input side of said low temperature cylinder is maintained at a difference level from 10° C. to 30° C. higher than the intermediate temperature of the surface of said low temperature cylinder.

7. An apparatus according to claim 6, wherein the temperature difference level between the heated belt at the input side and the intermediate temperature of the surface of said low temperature cylinder is about 20° C.

8. An apparatus according to claim 5, wherein said further cylinder heating means is comprised by said low temperature cylinder having a sealed interior for receiving steam heat therein for heating the surface of said low temperature cylinder to a desired intermediate temperature.

9. An apparatus according to claim 1, wherein said pressure means further includes an exit press roll located in proximity to an exit position of the web and said belts from an exit side of said low temperature cylinder.

10. An apparatus according to claim 9, wherein said input and exit press rolls are arranged on opposite sides of said low temperature cylinder.

11. An apparatus according to claim 9, wherein said input and exit press rolls are arranged at respective positions within about 30% of the circumference of said low temperature cylinder from the respective input or exit positions of the web.

12. An apparatus according to claim 6, wherein the heated belt is heated to a temperature from 140° C. to 170° C. at the input side of said low temperature cylinder.

13. An apparatus according to claim 6, wherein the surface of said low temperature cylinder is heated to a temperature from 100° C. to 140° C.

14. An apparatus according to claim 1, wherein said input press roll applies a nip pressure from 60 to 200 pli (pounds per linear inch).

15. An apparatus according to claim 6, wherein the heated belt is heated to a temperature of about 140° C. at the input side of said low temperature cylinder, the surface of said low temperature cylinder is heated to about 110° C., the input press roll applies a nip pressure of 100 pli, the negative air pressure at the surface of said low temperature cylinder is in the range of 0.1 to 0.7 bar, and the pressure of the heated belt on the web against the cylinder is in the range of 0.5 to 3.0 bar.

16. A method for drying a web of roll material, comprising the steps of:

providing at least one low temperature cylinder having an external cylinder surface;

entraining a heated belt and a porous belt to run in parallel with the web held between them with the porous belt in contact with the surface of the low temperature cylinder;

heating the heated belt to a desired elevated temperature at a contact position of the web and the belts on an input side of the low temperature cylinder;

applying in proximity to the contact position on the input side, as well as to a contact position on an exit side, of the low temperature cylinder a desired nip pressure to the heated belt against the web, the porous belt, and the surface of the low temperature cylinder;

heating the surface of the low temperature cylinder to a desired intermediate temperature;

maintaining the temperature of the heated belt at the input side of the low temperature cylinder at a difference level only 10° C. to 30° C. higher than the intermediate temperature of the surface of the low temperature cylinder; and simultaneously maintaining a negative air pressure at the surface of the low temperature cylinder so as to reduce vapor pressure and facilitate evaporation of water from the web through the porous belt to the surface of the low temperature cylinder.

17. A method according to claim 16, wherein the heated belt is heated to a temperature from 140° C. to 170° C. at the input side of the low temperature cylinder.

18. A method according to claim 16, wherein the surface of the low temperature cylinder is heated to a temperature from 100° C. to 140° C.

19. A method according to claim 16, wherein the applied nip pressure is from 60 to 200 pli (pounds per linear inch).

20. A method according to claim 16, wherein the heated belt is heated to about 140° C. at the input side of the low temperature cylinder, the surface of the low temperature cylinder is heated to about 110° C., the nip pressure is about 100 pli, the negative air pressure at the surface of the low temperature cylinder is in the range of 0.1 to 0.7 bar, and the pressure of the heated belt on the web against the cylinder is in the range of 0.5 to 3.0 bar.

* * * * *

UNITED STATES PATENT AND TRADEMARK OFFICE

CERTIFICATE OF CORRECTION

PATENT NO. : 5,291,666

DATED : March 8, 1994

INVENTOR(S) : Vladislav A. Babinsky et al.

It is certified that error appears in the above-identified patent and that said Letters Patent is hereby corrected as shown below:

On the Cover Page, in the Inventors section, delete "Vladislva" and insert --Vladislav--;

On the Cover Page, in The References Cited section, change the date of U.S. Pat. No. 2,209,761 from "7/1990" to --7/1940-- and change the name of U.S. Pat. No. 2,661,669 from "Friederich" to --Friedrich--.

Signed and Sealed this

Ninth Day of August, 1994

Bruce Lehman

*Attest:*

BRUCE LEHMAN

*Attesting Officer*

*Commissioner of Patents and Trademarks*